United States Patent [19]

Bodine

[11] Patent Number: 4,824,258

[45] Date of Patent: Apr. 25, 1989

[54] FLUID DRIVEN SCREW TYPE (MOYNO) SONIC OSCILLATOR SYSTEM

[76] Inventor: Albert G. Bodine, 7877 Woodley Ave., Van Nuys, Calif. 91406

[21] Appl. No.: 78,282

[22] Filed: Jul. 27, 1987

[51] Int. Cl.[4] ..... B01F 11/00; F01C 5/04; F03C 2/00

[52] U.S. Cl. ..... 366/118; 366/120; 366/124; 366/600; 418/48

[58] Field of Search ..... 366/120, 123, 124, 128, 366/117, 118, 119, 125, 241, 600; 175/55; 418/48; 210/738, 748; 134/184, 1

[56] References Cited

U.S. PATENT DOCUMENTS

| | | | |
|---|---|---|---|
| 2,479,799 | 8/1949 | Wilde | 366/123 X |
| 3,076,513 | 2/1963 | Heaphy | 175/55 X |
| 3,567,185 | 3/1971 | Ross et al. | 366/118 |
| 3,746,310 | 7/1973 | Fransson et al. | 366/120 |
| 3,903,000 | 9/1975 | Miura et al. | 210/748 X |
| 3,975,120 | 8/1976 | Tschirky | 418/48 |
| 4,261,425 | 4/1981 | Bodine | 175/55 X |
| 4,271,915 | 6/1981 | Bodine | 175/56 |
| 4,293,231 | 10/1981 | Lyle | 366/120 |

*Primary Examiner*—Harvey C. Hornsby
*Assistant Examiner*—Scott J. Haugland
*Attorney, Agent, or Firm*—Edward A. Sokolski

[57] ABSTRACT

A screw shaped rotor is freely mounted for rolling rotation in a mating screw shaped stator which is mounted in a housing. The rotor is rotatably driven by means of a fluid stream to generate sonic energy in the housing with a lateral mode of vibration at a frequency which is the function of the rate of fluid flow. The oscillator housing is coupled to the load which it drives uniformly along the entire length of the oscillator. The drive fluid for the oscillator is coupled thereto through a flexible coupling such as a section of rubber hose so that this coupled end of the oscillator is not substantially constrained against lateral vibration and is free to vibrate laterally along with the rest of the housing. The oscillator housing may be coupled along its entire length to the load to be vibrationally driven or can be suspended in a liquid which is to be vibrationally energized.

8 Claims, 3 Drawing Sheets

FLUID DRIVEN SCREW TYPE (MOYNO) SONIC OSCILLATOR SYSTEM

This invention relates to sonic oscillators and more particularly to a sonic energy system employing a fluid driven screw type (Moyno) mechanism for generating sonic energy by the rolling eccentricity of a rotor precessing around a stator.

Fluid driven Moyno pumps which employ screw shaped rotors rotatably driven by a fluid stream in a mating screw shaped housing have been known for some time and are described in French Pat. No. 850,942 to Moyneau S.A.R.L. issued on Sept. 25, 1939 and on Page 155 of *Pumps* by Kristal and Annett published by McGraw-Hill Book Company in 1940. It has been found by applicant that such a device can be adapted to generate sonic energy in a lateral mode of vibration and devices of this type are described in my U.S. Pat. Nos. 4,261,425 issued Apr. 14, 1981 and 4,271,915 issued June 9, 1981. In my U.S. Pat. No. 4,261,425, a conical tipping nutating type of vibration is provided with the top end of the oscillator vibrating with greater amplitude than the bottom end. In my U.S. Pat. No. 4,271,915 the top end of the oscillator also vibrates with greater amplitude than the bottom end, the bottom end vibrating in accordance with a lateral quadrature wave pattern established in the elastic bar member to which it is attached.

It has been found highly desirable in a number of applications, such as in transferring sonic energy to a liquid and in vibrating wide area loads, to vibrate the load in a single predetermined fixed phase rather than in a standing wave non-uniform pattern as in the prior art. This is particularly significant where the load is a large structure in which bending stresses which could be induced by non-uniform vibration are undesirable. Further, where coupling the sonic energy to a liquid contained in a rather large tank, such as in a leaching operation or the like, more efficient operation can be achieved if the energy is applied uniformly throughout the liquid. Further, driving one portion of the load in an out-of-phase relationship to another portion thereof can result in phase cancellation of some of the sonic energy which results in lower efficiency.

The present invention obviates the aforementioned shortcomings of the prior art by delivering sonic energy to a load in a single predetermined fixed phase along the entire length of the oscillator so that the energy is delivered to the load in a uniform fashion. This end result is achieved in the present invention by employing a "Moyno" type oscillator which comprises an elongated screw shaped roller driven around in a screw shaped stator by means of a fluid stream. Except for its coupling to the load, the oscillator is not significantly constrained at either end or along its length, the coupling of the fluid stream thereto being through a flexible coupling member which provides little constraint against the vibrational motion of the oscillator at the end thereof to which it is attached. In one embodiment of the invention, the "Moyno" screw shaped oscillator is coupled along its length to a sheet or wall of material to be vibrated while in another embodiment, the output of an elongated "Moyno" type oscillator is coupled to a fluid. The oscillator can be rather slender and elongated; such as of the order of six feet in length and three inches in diameter. Further, the frequency of vibration can be controlled by controlling the input fluid rate.

For example, in an operative embodiment of the invention, a rate of flow of 24 gallons per minute provides an oscillator output of 60 Hz while a flow rate of 48 gallons per minute will provide an output frequency of 120 Hz. Also, by providing two lobes in the rotor for every three grooves in the stator, two rolling vibration cycles are provided for each complete rotation of the rotor thus magnifying the frequency of the output. An even greater magnification of this frequency can be attained by increasing this ratio.

In a preferred form of this invention the stator has a molded internal screw shape and is of rubber to provide the support bearing for the rotor which precessionally rolls around on the stator. An important improvement of this invention provides additional cylindrical roller and race means at the adjacent ends of the stator and roller to pick up a portion of the cyclic centrifugal load in aid of the rubber stator's laterally uniform cyclic force output.

It is therefore an object of this invention to provide a sonic oscillator which is capable of delivering vibrational energy to a load in a unitary phase along the entire interface with such load.

It is a further object of this invention to provide a sonic oscillator which can provide sonic energy in a uniform manner to an elongated oscillator-load interface.

Other objects of the invention will become apparent as the description proceeds in connection with the accompanying drawings of which:

Figure 1:
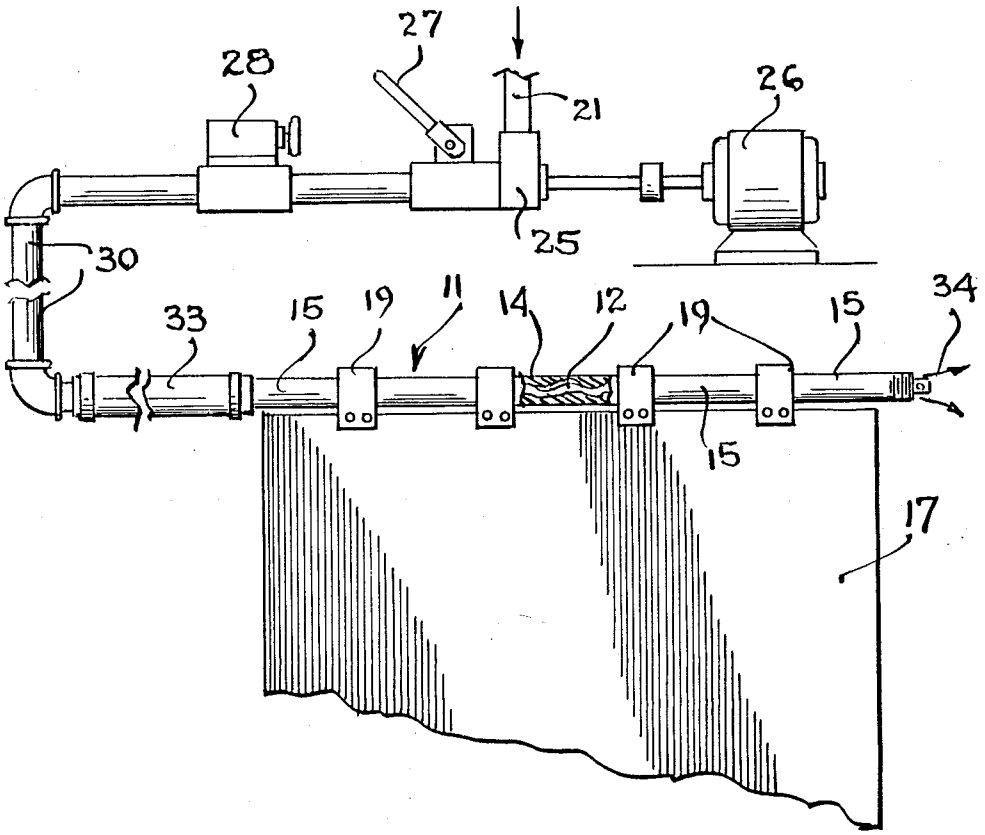
FIG. 1 is a schematic representation of a first embodiment of the invention.

Referring now to FIG. 1, a first embodiment of the invention as employed for driving an elongated wall or sheet of material is illustrated. Screw type (Moyno) oscillator 11 has an elongated screw shaped rotor 12 which is eccentrically supported for precessional rolling about in helical screw shaped stator 14. Rotor 12 is typically made of a metal such as steel while stator 14 is made of a resilient material such as rubber or a suitable elastomer. The stator is contained within a housing 15 which is directly clamped to plate member 17 by means of clamps 19 placed at spaced points along the housing. The submerged plate may be suspended in a tank as a radiator for washing of parts submerged therein, accelerating electroplating, stirring of pigments, accelerating the impregnation of dyes, etc. The rotor and stator run the entire longitudinal extent of housing 15 and typically may be of the order of six feet in length. Rotor 12 has two lobes formed thereon for every three grooves in the stator to provide two complete rotating vector vibration cycles in the oscillator output for each rolling rotation of the rotor. Rotor 12 is rotatably driven within its stator by means of a fluid stream fed into pipe member 21 which stream is propelled by means of a pump 25 driven by motor 26. The flow rate of the stream is controlled by means of pump lever 27 or be setting the adjustment screw on flow regulator valve 28. The fluid is fed through piping 30 and flexible conduit 33, which may comprise a coupling hose, to the input of the oscillator on one end thereof. The fluid is outleted as indicated by arrows 34 from the outlet end of the oscillator housing. Flexible conduit 33 is made flexible enough that the oscillator housing is not constrained significantly thereby.

In operation, the flow rate of the fluid stream is adjusted by means of lever 27 to set the rotational speed of rotor 12 to provide a desired frequency for the lateral vibrational output in housing 15 which is coupled to the load 17. In view of the fact that there are no significant constraints on either end of the oscillator housing, the entire housing vibrates in unison which provides vibrational energy along the entire interface between the oscillator housing and the load 17 in a common phase. Thus, the entire edge of plate or wall member 17 is vibrated back and forth together in unison. It has been found highly desirable to make the mass of the stator per linear inch less than five times that of the rotor to keep down the stator's blocking impedance inertia effect. This end result can be readily achieved by utilizing a low mass material for the internal stator such as rubber or plastic while the rotor is made of a high mass material such as steel.

Figure 2:
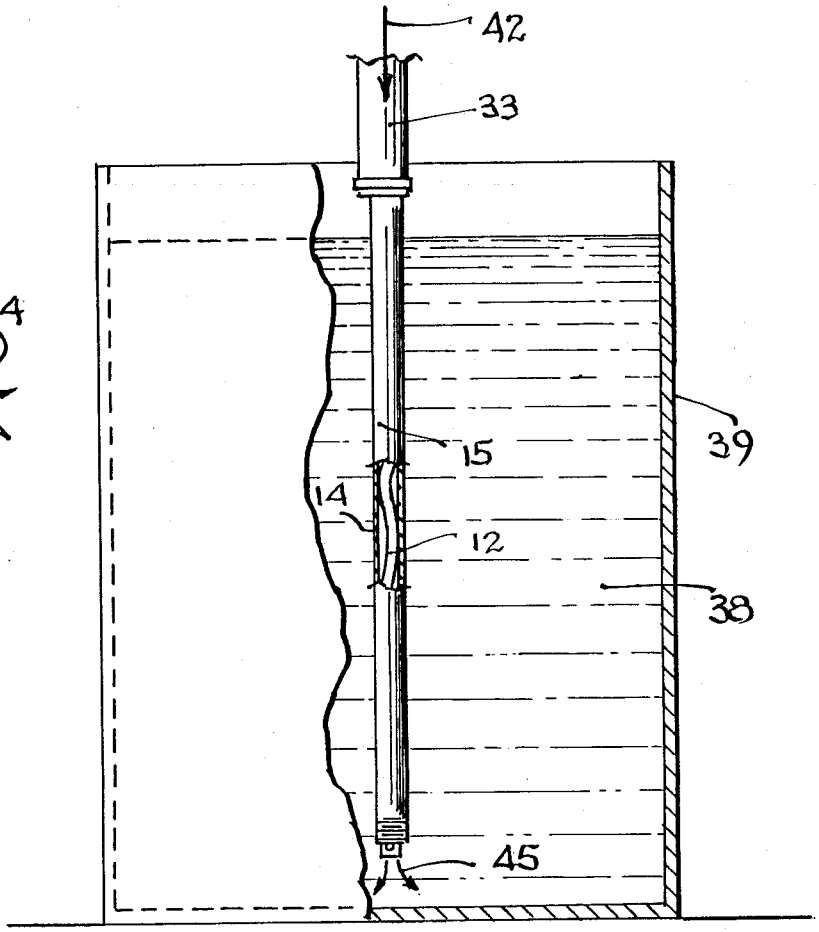
FIG. 2 is a schematic representation of a second embodiment of the invention.

Referring now to FIG. 2 a second embodiment of the invention is shown. In this embodiment, the Moyno oscillator which is similar in configuration to that of the previous embodiment has its housing 15 suspended in a liquid 38 contained within tank 39. As for the previous embodiment, the top end of the oscillator is coupled to the fluid piping through a flexible coupling hose 33 which is sufficiently flexible to minimize the constraint placed on the motion of the oscillator housing. Liquid 38 may be a leaching solution into which ore is fed in a leaching operation, the sonic energy enhancing such operation by facilitating the separation of metal from the ore. A liquid stream, as indicated by arrow 42, is fed to rotatably drive rotor 12, the liquid stream being exited from the bottom end of the oscillator housing as indicated by arrows 45. As for the previous embodiment, the entire oscillator housing 15 is vibrated laterally in unison in a common phase such that the sonic energy is transferred uniformly along the entire length of the oscillator without any phase differences therealong which might result in phase opposition conditions which would tend to be dissipative of the sonic energy.

The embodiment of FIG. 2 is especially useful for radiating sonic energy in tanks and wells such as in cleaning operations.

Figure 3:
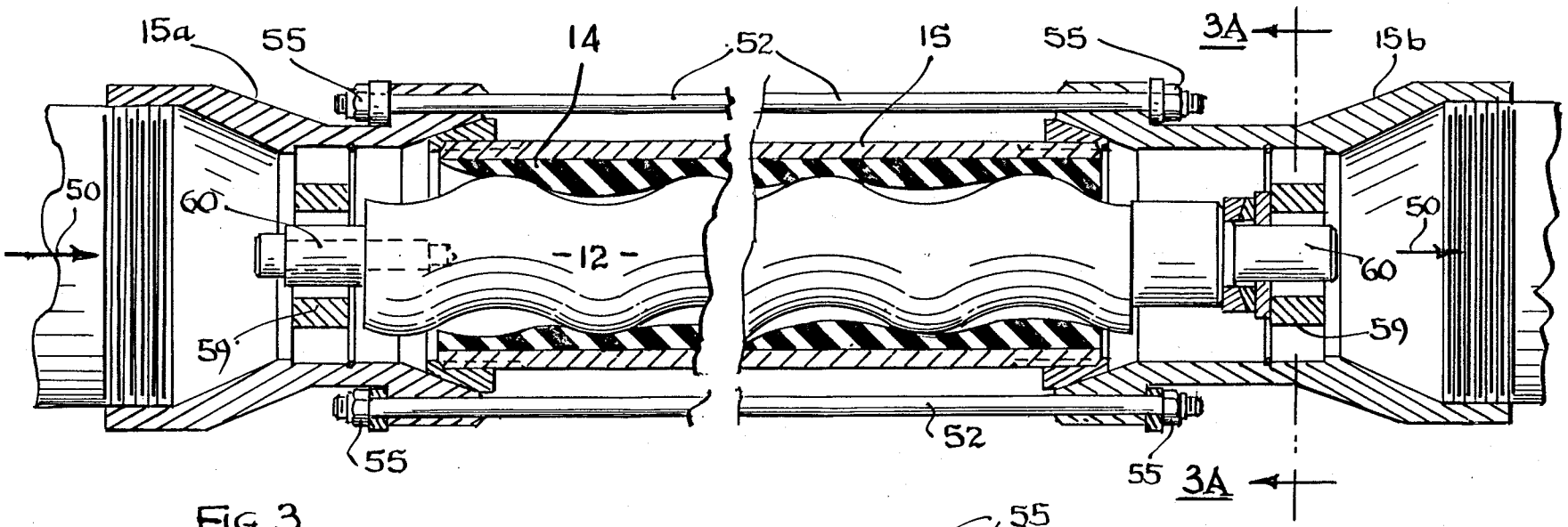
FIG. 3 is a side elevational view partially in cross section of a first embodiment of an oscillator which may be employed in the system of the invention.
Figure 3A:
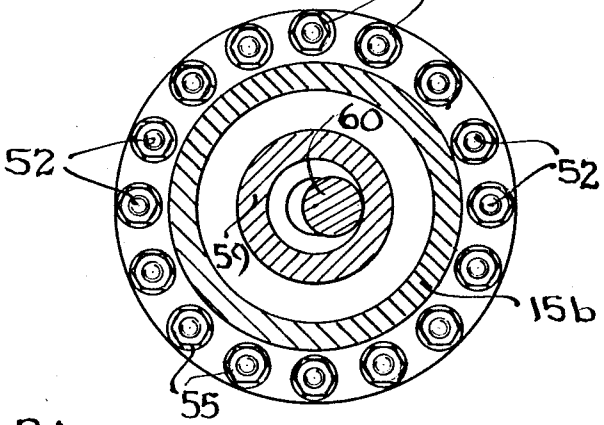
FIG. 3A is a cross sectional view taken along the plane indicated by 3A—3A in FIG. 3.

Referring now to FIGS. 3 and 3A, a first embodiment of an oscillator which may be employed in the system of the invention is illustrated. Rotatably mounted within housing 15 within stator 14 is screw shaped rotor 12. Rotor 12 is typically made of a metal such as steel while stator 14 is of a resilient material such as suitable rubber or a synthetic elastomeric material. Opposite end portions **15*a* and 15*b* of the housing are provided as an inlets and outlet for the fluid flow to the housing indicated by arrows 50. These opposite end portions are retained on the housing by means of a plurality of tension rods 52 which are fitted through apertures in the end portions and tightened to the housing by means of nuts 55. Bearing races 59 are provided in the housing around which roller members 60, which are attached to the opposite ends of rotor 12, can ride. With the orbital rolling precession from the rotatable drive of rotor 12 being effected by the liquid stream 50, a lateral vibratory force is generated along the entire length of housing 15 in a uniform common phase. The longitudinal center of mass of rotor 12** describes an orbital path to generate the vibration. In this embodiment, the stator has three grooves for every two lobes in the rotor to provide two orbital precession vibration cycles for each rotation of the rotor.

Figure 4:
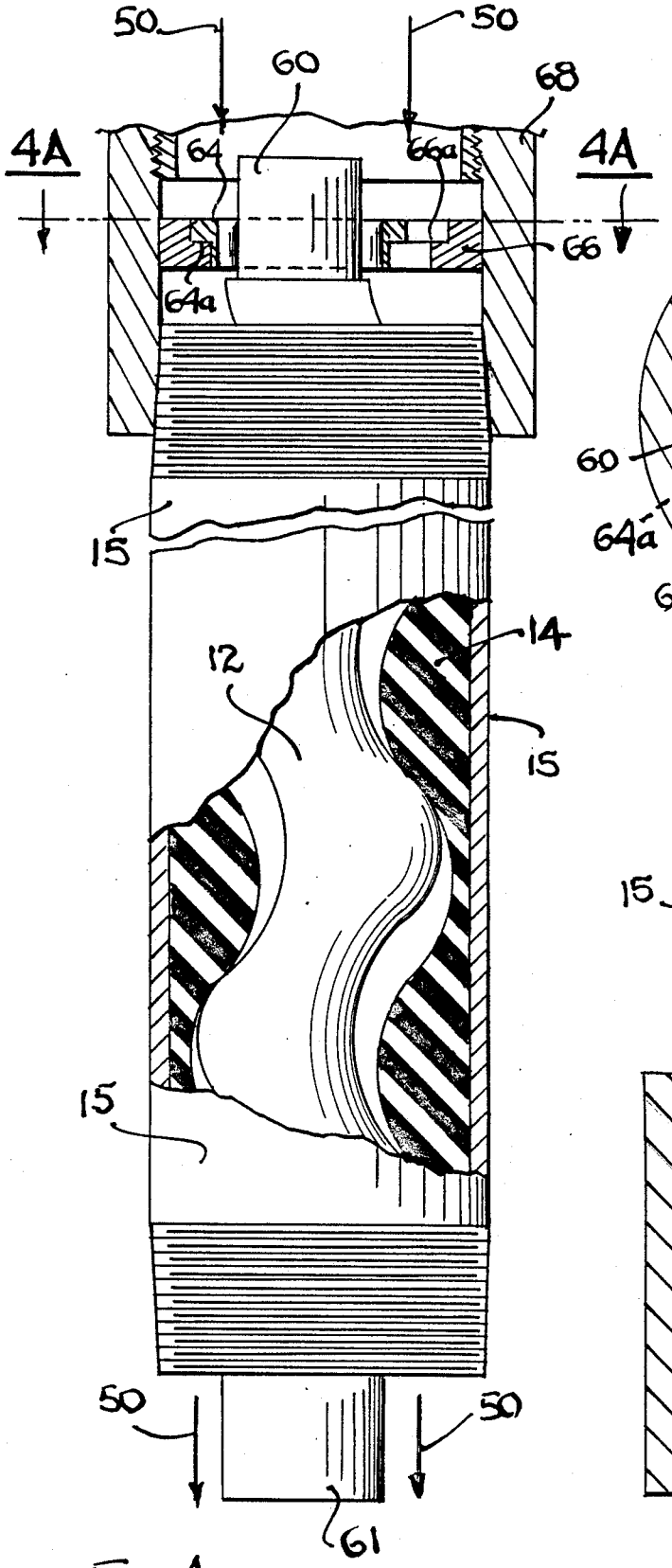
FIG. 4 is an elevational view in cross section of a second embodiment of an oscillator which may be employed in the system of the invention.
Figure 4A:
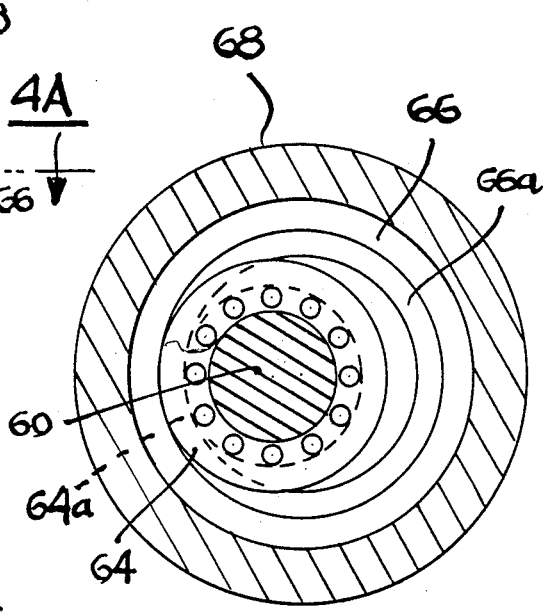
FIG. 4A is a cross sectional view taken along the plane indicated by 4A—4A in FIG. 4.

Referring now to FIGS. 4 and 4A, an alternative configuration for the Moyno oscillator of the invention is illustrated. This embodiment employs roller bearings on the opposite ends of the rotor which are needed to handle the high radial orbiting force of the rotor in higher frequency applications (100 Hz or higher). It has been found that, particularly with such high frequency operation, large sheer strains tends to occur at the end regions of the stator with stators made of an elastomeric material. This problem is particularly accentuated at the end regions of the stator which are unsupported laterally in view of the fact that the elastomeric stator does not extend to these regions. This can cause overheating of the end regions of the stator and tearing of the elastomeric material due to excessive cyclic straining. Roller bearings to support the ends of the stator are employed to alleviate this problem in the configuration of the oscillator of FIGS. 4 and 4A.

The end 60 of the rotor 12 has a roller bearing 64 press fitted thereto. Race 66 which provides a mating bearing surface for roller 64 is press fitted within the pipe coupling 68 threadably joined to the end of housing 15. The difference in diameter between roller 64 and race 66 is commensurate with the rolling orbit of the rotor in its stator so that the roller and race provide a bearing for the rotor and maintain radial load bearing and rolling contact as the rotor travels in its rolling orbit within the stator.

Race 66 and roller 64 are made of hardened alloy steel or of a conventional ceramic baring material so as to provide sufficient rigidity to pick up most of the radial orbiting load from the Moyno rotor, thus alleviating excessive strain on the stator. The orbiting contact point or "footprint" of the roller in its race is substantially in rotational phase with the orbiting centrifugal force vector of the stator. Therefore, the orbiting force picked up by the race 66 is delivered to the pipe coupling 68 in phase as an additive to the orbiting force from the stator housing, these combined forces being cooperatively delivered to the load.

Mating axial load bearing flanges **66*a* and 64*a* are provided on race 66 and roller bearing 64** respectively. These flanges carry axial loads as they roll across each other and thus operate to maintain the rotor in place axially within the stator against the hydraulic pressure of the rotor drive fluid.

Figure 4B:
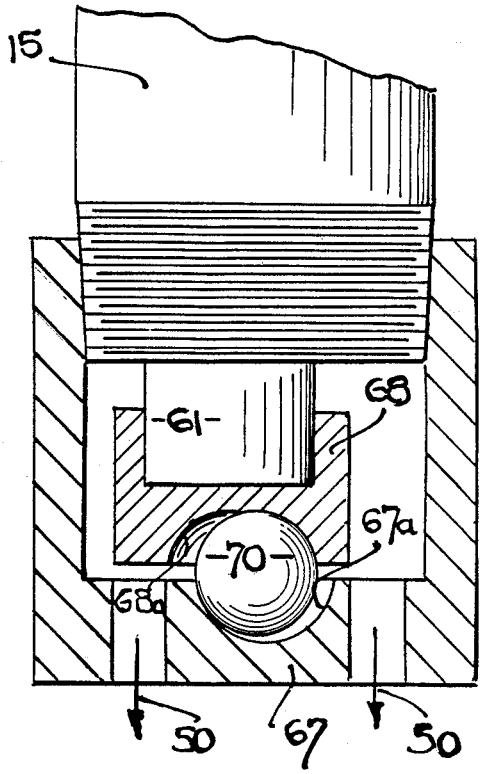
FIG. 4B is a cross sectional view taken along the plane indicated by 4B—4B in FIG. 4.

Referring to FIG. 4B, the fluid outlet end of the stator may have a different type of bearing thereon which employs a ball and socket race type bearing mechanism. End cap 68 is press fitted onto rotor end 61, this end cap having a socket type race **68*a* formed therein which is in the form of a radially expanded ellipse and which carries ball bearing 70 in rolling engagement around the periphery thereof. Threadably attached to the end of housing 15 is an end cap 67. Formed in the inner wall of this cap in diametrically opposite position to socket 68*a* is a similar elliptical socket race 67***a* in which the ball rides. The elliptical eccentricity of the two sockets corresponds to the orbiting eccentricity of the rotor 12 much like the diametrical difference between the rotor 64 and race 66. The geometrical center of the ball socket 68*a* lines up with the axis of rotor 12 while socket 67*a* is aligned with the longitudinal axis of stator 14. As a result, the precessional orbit of the rotor holds the free ball in rolling engagement with the diametrically opposite portions of the two relatively moving sockets. This dimensioning assures that the ball bearing 70 picks up the excessive radial load from the rotor. The two socket races and the ball bearing thus operate to handle the radial and axial loads.

The embodiments of FIGS. 3 and 4 are particularly applicable for use as a fishing tool in a well wherein it is desired to vibrationally loosen an elongated pipe string which is stuck within the well bore over a substantial distance interval. The above described unitary phase of delivery of sonic energy such as from thread connection 15*b* to the stuck pipe provides uniformly strong sonic action into the environment over the extended length of stuck pipe interval and also radiates sonic energy from housing 15 into the well fluid body generally there adjacent so as to aid the freeing of the pipe.

While the invention has been described and illustrated in detail, it is to be clearly understood that this is intended by way of illustration and example only and is not to be taken by way of limitation, the spirit and scope of this invention being limited only by the terms of the following claims.

I claim:

1. A system for providing sonic vibrational energy to a load comprising:

an orbital oscillator including a housing, an elongated screw shaped stator mounted in said housing and an elongated screw shaped rotor mounted for precessionally rolling rotation freely in said stator;

a fluid inlet formed in one end of said housing;

a fluid outlet formed in the end of said housing opposite said one end thereof;

means for supporting said housing;

liquid drive means fed into said fluid inlet and exited from said fluid outlet for rotatably driving said freely mounted rotor at a rolling precessional speed such as to effect orbital lateral sonic vibration of said housing; and means for coupling substantially the entire extent of said housing to said load to transfer said sonic vibration thereto in a uniform in-phase manner through the coupling between the housing and the load;

said rotor drive means and said means for supporting said housing being coupled to said rotor and said housing respectively so as to effect minimal constraint to the lateral vibration of said housing.

2. The system of claim 1 wherein the load comprises a plate member, said housing being clamped to said plate member at spaced points therealong.

3. The system of claim 2 wherein the means for rotatably driving the rotor comprises a fluid stream, means for driving said fluid stream at a predetermined flow rate, and flexible conduit means for coupling said fluid stream to said rotor, the means for supporting the oscillator housing including said flexible conduit means.

4. The system of claim 1 wherein the load comprises a liquid, said means for supporting said housing comprising means for suspending said housing in said liquid.

5. The system of claim 4 wherein the means for rotatably driving the rotor comprises a fluid stream, means for driving said fluid stream at a predetermined flow rate, and flexible conduit means for coupling the fluid stream to said rotor, said flexible conduit comprising said means for suspending said housing in said liquid.

6. The system of claim 1 wherein the screw shape of said rotor is dimensioned relative to the screw shape of said stator to provide at least two vibration cycles of said housing for each complete rotation of said rotor.

7. The system of claim 1 and further including bearing means for supporting the opposite ends of the rotor on said stator, said bearing means being adapted to carry a portion of the radial vibrational force of the rotor acting against the stator.

8. The system of claim 7 wherein said bearing means comprises rollers connected to the ends of said rotor and races mounted in the ends of said stator, said rollers rolling around within said races to carry said portion of the radial vibrational force.

* * * * *